United States Patent [19]

Adams

[11] Patent Number: 4,873,932

[45] Date of Patent: Oct. 17, 1989

[54] STEPPER DRIVEN STITCH PATTERNING MECHANISM FOR SEWING MACHINES USING SPIRAL CAM GROOVE AND FOLLOWER

[75] Inventor: Kenneth D. Adams, Madison, N.J.

[73] Assignee: SSMC Inc., Fairfield, N.J.

[21] Appl. No.: 304,540

[22] Filed: Feb. 1, 1989

[51] Int. Cl.[4] ..... D05B 3/02

[52] U.S. Cl. ..... 112/443; 112/220; 112/455; 74/569

[58] Field of Search ..... 74/569; 112/443, 455, 112/220

[56] References Cited

U.S. PATENT DOCUMENTS

| | | | |
|---|---|---|---|
| 4,131,075 | 12/1978 | Wurst | 112/453 |
| 4,196,683 | 4/1980 | Eguchi | 112/455 |
| 4,559,887 | 12/1985 | Sano | 112/455 |

*Primary Examiner*—Andrew M. Falik

*Attorney, Agent, or Firm*—Theodore C. Jay

[57] ABSTRACT

A sewing machine employing a stepper driven-stitch patterning mechanism including a stepper rotated cam with a spiral cam groove tracked by a follower formed with different cross sectional shape than the cam groove in order to provide only point contact with each side of the cam groove when spring biased therein. A spring arrangement biases the cam and follower together in a direction perpendicular to the axis of cam rotation, thus minimizing lost motion between cam and follower.

7 Claims, 2 Drawing Sheets

STEPPER DRIVEN STITCH PATTERNING MECHANISM FOR SEWING MACHINES USING SPIRAL CAM GROOVE AND FOLLOWER

DESCRIPTION

1. Background of the Invention

This invention relates to sewing machines having stitch patterning capability by variations of needle jogging movement as well as magnitude and direction of work feed. More particularly, this invention relates to drive mechanism for controlling pattern influencing movements of a sewing machine stitch forming instrumentality in response to stepper motor actuation as dictated by electronic stitch pattern data.

2. Description of the Prior Art

The use of stepper motors as electro-mechanical actuators for translating electronically stored stitch pattern data into stitch patterning movements of sewing machine stitch forming instrumentalities is well known. Since the stepper generated motion in this environment is typically in opposite directions on alternate stitches or stitch groups, lost motion or backlash in the stepper driven mechanism is particularly detrimental to accurate stitch pattern formation. The U.S. Pat. No. 4,131,075 Dec. 26, 1987 of John W. Wurst relies for control of such lost motion and backlash simply upon maintenance of close tolerances between the parts, which is not only costly but subject to deterioration upon wear between the engaging parts.

The U.S. Pat. No. 4,559,887 Dec. 24, 1985 of Yasuro Sano provides spring means actuating in one direction of the force transmitted by the stepper to the drive mechanism to eliminate lost motion which disadvantageously favors stepper drive in one direction resulting in objectionable imbalance in the stitch pattern formation particularly noticable at higher speeds of sewing machine operation.

SUMMARY OF THE INVENTION

It is an object of this invention to provide a stepper actuated drive mechanism for imparting stitch patterning movements to a sewing machine stitch forming instrumentality which mechanism is simple and cost effective and in which a spring biasing arrangement is provided between the parts for minimizing lost motion without favoring the stepper actuated drive in either of the opposite directions. This object of the invention is attained by the provision in the drive mechanism of a cam rotated by the stepper and formed with a tapered radial cam groove tracked by a follower shaped so as to maintain point contact with both sides of the tapered cam groove for movement of the follower axially of the cam upon stepper rotation. By the provision of spring means biasing the cam and follower together in a direction perpendicular to the axis of cam rotation lost motion between cam and follower is minimized without favoring either direction of stepper drive and wear between the parts is automatically compensated.

BRIEF DESCRIPTION OF THE DRAWINGS

With the above and additional objects and advantages in view, as will hereinafter appear, this invention will now be described with reference to the preferred embodiments illustrated in the accompanying drawings in which.

DETAILED DESCRIPTION

Figure 1:
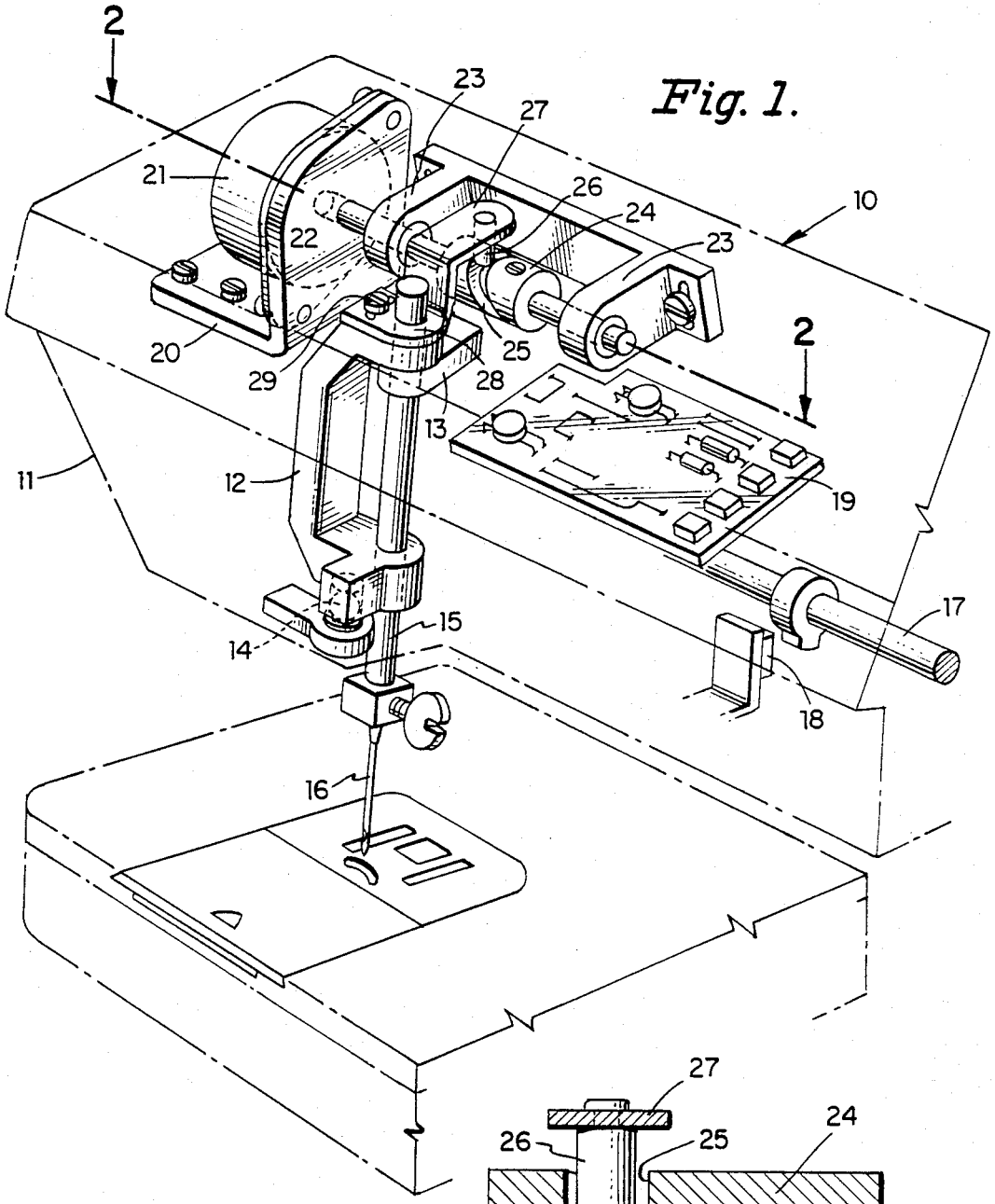
FIG. 1 is a perspective view of a portion of a sewing machine including a laterally jogging needle bar and a stepper actuated mechanism for jogging the needle bar in accordance with this invention.

As illustrated in FIG. 1 reference numeral 10 indicates the bracket arm of a sewing machine frame in the head end portion 11 of which a needle bar gate 12 is journaled on vertically spaced bearings 13 and 14. A needle bar 15 is carried for endwise reciprocation in the needle bar gate 12 on an axis spaced from and preferably inclined with respect to the needle bar gate axis defined by the bearings 13 and 14 so that upon oscillation of the needle bar gate, the needle bar, and particularly the lower portion thereof to which a needle 16 is secured, will be jogged laterally to produce zig zag stitches.

An arm shaft 17 journaled in the bracket arm may be provided with any well known crank mechanism for imparting endwise reciprocation to the needle bar and a pulse generator 18 may also be driven by the arm shaft for cooperation with any known electronic stitch pattern memory 19 in the sewing machine.

Secured in the head end portion 11 of the bracket arm 10, as by fastening 20 is a stepper motor 21 adapted in response to stitch pattern instructions from the memory 19 to rotate in discreet direction and number of predetermined angular steps during each needle reciprocation so as to impart lateral jogging motion to the needle 16 in the selected pattern. The stepper shaft 22 may be similarly constrained in bearings 23 secured in the sewing machine bracket arm. A cam 24 is secured on the stepper motor shaft 22 and formed with a spiral cam groove 25 illustrated in greater detail in FIG. 2. Projecting into the cam groove 25 is a follower member 26 carried by a leaf spring 27 which is formed as a part of or secured to a bracket 28 which bracket 28 is secured as by fastenings 29 for limited angular adjustment on the needle bar gate 12 preferrably above the upper bearing 13 thereof.

Figure 2:
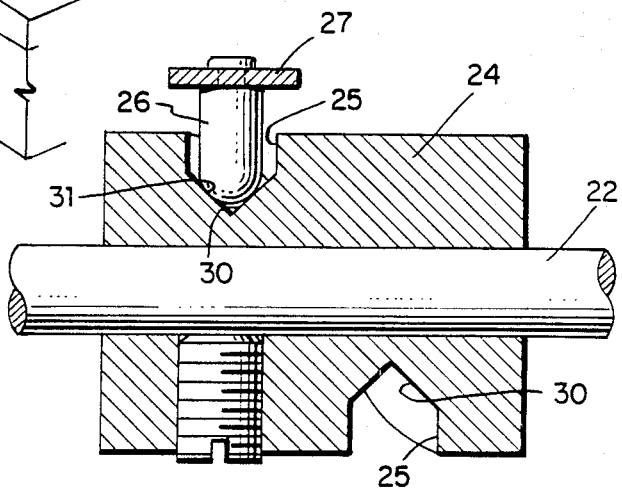
FIG. 2 is an enlarged cross sectional view taken along line 2—2 coaxially of the stepper driven cam and the cam follower of FIG. 1.

Referring to FIG. 2, the cam groove 25 is preferrably formed with an inverted "V" shaped bottom surface 30 and the follower member 26 is formed preferrably with a semi-spherical shaped extremity 31 so as to make point contact simultaneously with each side of the inverted "V" shaped cam groove bottom surface 30. The leaf spring 27 which supports the follower member 26 is arranged so as to bias the follower upwardly into the cam groove tightly maintaining the point contact of the semi-spherically shaped follower extremity 31 with each side of the cam groove bottom surface 30.

Although the above described combination of cam and follower shapes provide a preferred interrelation, a variety of other combinations such as arcuate concave cam groove bottom and a square or conical cam follower extremity will provide similar results if the relationships provide simultaneous point contact with each side of the cam groove.

Because the point contact, the frictional forces developed between the cam and spring based follower will be exceedingly small with minimal adverse loading on the stepper motor drive. Since the spring force is exerted by the follower on the cam groove in a direction perpendicular to that in which the follower is shifted by the cam, neither direction of cam influence is favored, and therefor no imbalance in the stitch pattern will occur. The simultaneous point contact of the follower with both sides of the "V" shaped cam groove bottom and the maintenance of the simultaneous contact by the force of the spring 27 substantially eliminates any lost motion or backlash when the direction of the stepper drive motor changes.

Figures 3, 4:
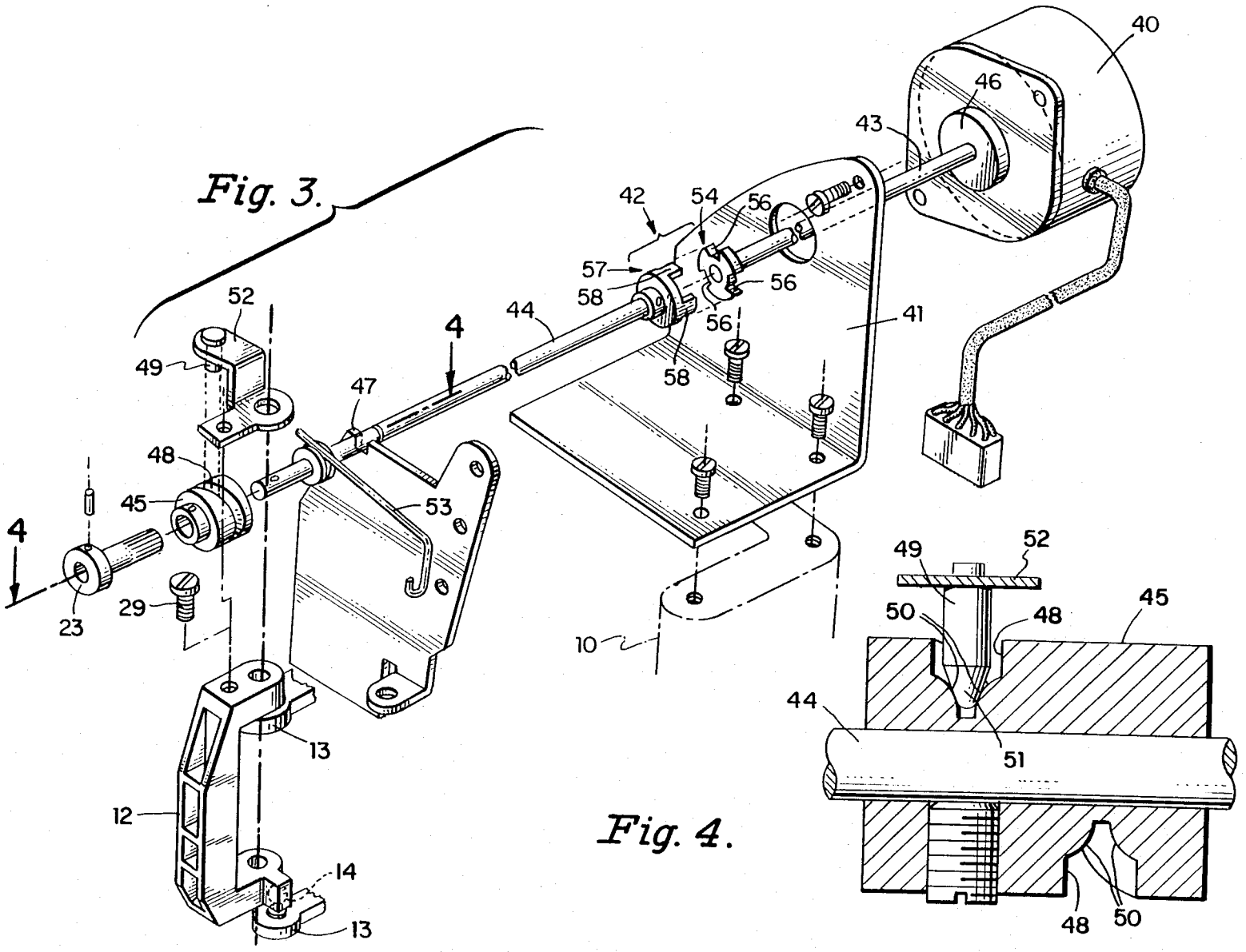
FIG. 3 is a disassembled view of a modified form of the stepper actuated drive mechanism of this invention.
FIG. 4 is an enlarged cross sectional view takenalong line 4—4 coaxially of the stepper driven cam of FIG. 3 with the follower in tracking relation.

Since the above described arrangement does not require high degree of dimensional tolerance a particularly cost effective drive mechanism is provided. Moreover, the subject arrangement will continue to sustain all the above advantageous results despite substantial wear between the engaging surfaces of the parts. There are numerous considerations in the design of sewing machines which influence the space available for housing mechanism in specific locations within the sewing machine frame. For operator visibility of the stitching point on fabrics being stitched, it has frequently been found desireable to minimize the shape of the head end portion of the sewing machine bracket arm. In this case, location of the stepper motor in a position illustrated in FIG. 1 would be disadvantageous. FIG. 3 illustrates a modified arrangement embodying the features of this invention, but in which the stepper motor may be located well within the bracket arm 10 of the sewing machine frame and away from the sewing head.

In the modification illustrated in FIG. 3 a stepper motor 40 is supported by fastenings 41 within the sewing machine bracket arm 10 in spaced relation from the head end portion 11. A flexible connection indicated generally at 42 separates a shaft 43 extending coaxially from the stepper motor 40 from a cam shaft 44 to which a cam 45 is made fast. The stepper motor shaft 43 may be additionally supported by a bearing 46 in the sewing machine bracket arm coaxially with the stepper motor 40. The cam shaft 44 however, is not fixedly supported in the bracket arm, but rather it is simply constrained by guide means 47 for vertical movement laterally of the cam shaft axis and in a plane parallel to that occupied by the stepper motor shaft 43.

The cam 45 is formed with a spiral cam groove indicated generally at 48 which is entered and tracked by a cam follower 49. In contrast to cam 24 of the embodiment shown in FIGS. 1 and 2, the bottom of the cam groove 48 of cam 45 is formed at each side with surface 50 having cross sectional convex circular shape. The cam follower 49 is formed with a conical shaped extremity 51. As shown in FIG. 4, the conical extremity 51 of the follower 49 makes point contact simultaneously at each side with the convex surface 50 at the bottom of the cam groove 48.

The cam follower 49 is supported on the needle bargate 12 by a rigid non flexible bracket 52. A spring 53 anchored on the bracket arm 10 of the sewing machine frame bears against biases the cam shaft 44 latally of the cam shaft axis downwardly so as to force the cam 45 into contact with the cam follower 49.

Because of the spring loading, the cam shaft 44 and stepper motor shaft 43 may assume varying misalignment which is accomodated by the flexible connection 42 therebetween. Preferrably the flexible connection 42 comprises a metalic coupling element 54 secured on the stepper shaft 43 including a flange 55 formed with three equally spaced radial slots 56 outwardly extending thereon. Secured on the cam shaft 44 is a coupling element 57 preferrably formed of plastic material such as DELRIN and including three equally spaced axially extruding fingers 58 each constrained in one of the radial slots 56 by the coupling element 34 on the stepper motor shaft 43. Although not as cost effective as the embodiment of FIGS. 1 and 2, the construction illustrated in FIG. 3 does provide freedom in location of the stepper motor. In other respect the same objects and advantages are provided by both embodiments; lost motion is eliminated; neither direction of stepper rotation is favored; wear between engaging parts of cam and follower is accommodated; and the frictional forces incident to cam follower engagement are minimized.

Although the preferred embodiments are illustrated and described herein as applied to the drive for needle jogging motion, it will be appreciated that these mechanisms may be used with similar advantages to the control of work feed magnitude and direction.

Having set forth the nature of this invention, what is claimed herein is:

1. In a sewing machine having a frame, stitch forming mechanism carried in said frame for stitch forming and stitch pattern influencing motion, a stepper motor secured in said sewing machine frame, and drive mechanism responsive to actuation from said stepper motor for imparting said stitch pattern influencing motion to said stitch forming instrumentality, said drive mechanism comprising:

a cam supported in said sewing machine frame, and having an axis of rotation, a drive connection between said stepper motor and said cam, a spiral cam groove formed in said cam and extending radially of the axis of rotation of said cam, a cam follower having a free extremity adapted to track said cam groove, a cam follower support operatively associated with said stitch forming instrumentality, said cam follower carried on said cam follower support in a position extending substantially radially of said cam rotation axis, said cam groove and said follower extremity each having different cross sectional shapes, said shapes being interrelated to provide simultaneous point contact of the cam follower with each side of said cam groove, and spring means biasing said cam and said cam follower into engagement to maintain said point contact of said cam follower with each said of said cam groove.

2. Sewing machine stitch pattern influencing drive mechanism as set forth in claim 1 in which said cam groove is formed with an inverted "V" shaped bottom surface, and in which said cam follower extremity is formed with a convex semi spherical shape interrelated with said inverted "V" shaped cam groove bottom so as to provide simultaneous point contact of the cam follower with each side of said cam groove.

3. Sewing machine stitch pattern influencing drive mechanism as set forth in claim 1 in which said cam follower extremity is formed with a conical shape, and in which said cam groove bottom is formed at each side with a convex circular segmental shape interrelated with said conical cam follower extremity so as to provide simultaneous point contact of the cam follower with each side of the cam groove.

4. Sewing machine stitch pattern influencing drive mechanism as set forth in cliam 1 in which means are provided supporting said cam on a fixed axis of rotation in said sewing machine frame, and in which cam follower support includes said spring means biasing said cam follower into engagement with said cam groove.

5. Sewing machine stitch pattern influencing drive mechanism as set forth in claim 1 in which said cam follower support comprises a rigid bracket to which said cam follower is secured, in which guide means are provided on said sewing machine frame constraining said cam axis of rotation for movement toward and away from said cam follower, and in which said spring means biasing said cam and said cam follower into engagement comprises a spring carried on said sewing machine frame and arranged to force said cam toward said rigidly supported cam follower.

6. In a sewing machine having a frame, a needle bargate journaled on an axis in said frame, a needle carrying bar endwise reciprocable on said needle bargate on an axis spaced from that of said needle bar gate, a stepper motor in said sewing machine frame and drive mechanism responsive to actuation from said stepper motor for oscillating said needle bar gate to impart stitch pattern influencing zig zag motion to said needle, said drive mechanism comprising;

a cam secured on a cam shaft journaled on an axis of rotation in said sewing machine frame and driven by said stepper motor, a spiral cam groove formed in said cam and extending radially of the axis of rotation of said cam shaft, a cylindrical cam follower having a free extremity adapted to track said cam groove, a bracket secured for oscillation with said needle bar gate and including a leaf spring extending from the axis of oscillation of said needle bar gate, said cam follower carried by said leaf spring in a position substantially perpendicular to said cam shaft axis of rotation and biased thereby into tracking engagement with said cam groove, and said cam groove and said cam follower extremity each having different cross sectional shapes interrelated to provide simultaneous point contact of the cam follower with each side of the cam groove.

7. In a sewing machine as set forth in claim 6 in which said cam follower is carried directly on an inflexible bracket secured for oscillation with said needle bar gate, in which guide means are provided constraining said cam shaft for lateral movement toward and away from said cam follower, in which spring means are provided on said sewing machine frame biasing said cam shaft laterally toward said cam follower and in which a flexible drive connection is provided for accommodating lateral movement of said cam shaft, with respect to said stepper motor.

* * * * *